US006026771A

United States Patent [19]

Escobosa

[11] Patent Number: 6,026,771

[45] Date of Patent: Feb. 22, 2000

[54] VARIABLE ACTUATION OF ENGINE VALVES

[76] Inventor: Alfonso S. Escobosa, 2034 Brittany Pl., Placentia, Calif. 92670

[21] Appl. No.: 09/317,601

[22] Filed: May 24, 1999

[51] Int. Cl.[7] ..... F01L 9/02

[52] U.S. Cl. ..... 123/90.12; 123/90.11

[58] Field of Search ..... 123/90.11, 90.12, 123/90.13, 90.14

[56] References Cited

U.S. PATENT DOCUMENTS

| | | | |
|---|---|---|---|
| 4,244,553 | 1/1981 | Escobosa | 251/57 |
| 4,296,911 | 10/1981 | Escobosa . | |
| 4,829,947 | 5/1989 | Lequesne | 123/90.11 |
| 4,930,464 | 6/1990 | Letsche | 123/90.12 |
| 5,222,714 | 6/1993 | Morinigo et al. | 251/129.16 |
| 5,335,633 | 8/1994 | Thien | 123/90.12 |
| 5,410,994 | 5/1995 | Schechter | 123/90.12 |
| 5,572,961 | 11/1996 | Schechter et al. | 123/90.12 |

*Primary Examiner*—Weilun Lo

[57] ABSTRACT

This invention pertains to a variable actuation system for engine valves. It is based on the natural oscillatory motion of two, hydrostatically coupled masses. One mass consists of an engine valve having a piston at the tip of its stem, the other mass consists of a spring-sprung master piston that is electromagnet-controlled at each end of travel. Separate half cycles of essentially sinusoidal motion of the couples masses are initiated and terminated by alternately releasing and capturing the spring driven master piston at its peak amplitudes which corresponds to the open and closed positions of the valve.

9 Claims, 5 Drawing Sheets

VARIABLE ACTUATION OF ENGINE VALVES

BACKGROUND—FIELD OF THE INVENTION

This invention relates to actuation of engine valves capable of independent control of their opening and closing points.

BACKGROUND—PRIOR ART

Various systems have been conceived that provide variable actuation of engine valves. Toward this end, a few systems dispense with the cam shaft as a drive source and rely on a source that is more readily controllable. In one particular development belonging to this class, control is by force increments imparted by either a bipolar or bistable electromagnet on an oscillatory spring-sprung valve at the start and end of each half cycle of motion. The start and end instances correspond to the opening and closing instances of the valve. Timing of the instances is effected by releasing and recapturing the potential energy stored in a pair of centering springs attached at the tip of the valve stem. When the springs are in their neutral position, a disc configured armature which is also attached to the tip of the valve stem is at an equal distance from two stators of the bipolar or bistable electromagnet. The positions of the two stators correspond to the closed and fully opened positions of the valve. For the system in which bipolar electromagnets are used, actuation is started by first pulling the valve from the neutral half-opened position to either the opened or closed position depending on the angular position of the engine. Thereafter the electromagnet alternately releases and captures the spring-sprung valve at the end of each half cycle of motion as dictated by an engine computer. A detailed description of the system is given in U.S. Pat. No. 5,222,714 entitled "Electromagnetically Actuated Valves" and in a similar system in U.S. Pat. No. 4,829,947 entitled "Variable Lift Operation of Bistable Electromechanical Poppet Valve Actuator". The primary difference between these patents appears to be the type of electromagnet used.

A major problem of the stated prior arts is unequal thermal expansion of the valve relative to the engine head on which the stators of the electromagnets are mounted. The unequal expansion shifts the center point of oscillation of the armature relative to the stators. Some amount of shift is also unavoidable because of tolerances in the assembly of the armature and the two stators. Since it is imperative that the valve fully closes in spite of the shift, a non-zeroing airgap between the armature disc and the top, valve-closing stator must be provided. Unfortunately the non-zeroing clearance requires more power to be applied to the coil of the top stator in order to hold the captured valve closed against the pull of the centering springs. On the opposite side of the armature, the armature disc will still impact the bottom, valve-opening stator with a degree of harshness dependent on the magnitude of the clearance minus valve seat wear, and on temperature variation and assembly variances. Thus, not only is higher power required, but also excessive impact and wear results.

The proposed solution to this problem is to separate the spring-sprung mass of the stated prior arts into two hydrostatically coupled units, one containing the mass of the valve and the other, the mass of an electromagnetic latchable spring-sprung piston. It will be shown that this configuration automatically synchronizes the closing of the valve with the capture of the piston, significantly reducing power, noise and wear. It will also be shown that operation of the system is possible with much smaller electromagnets.

OBJECT AND ADVANTAGES

The object of the invention is to vary the opening and closing of the engine valves with an actuation system that is low cost, operationally versatile and free of problems such as excessive noise and wear. The invention accomplishes this objective with a configuration consisting of two hydrostatically couple units. One unit is a master unit that has a spring-sprung mass consisting of an unbalanced piston that is electromagnetically latched and released. The other unit is a slave unit that has a mass consisting of an engine valve that is driven by an unbalance piston located at the tip of the valve stem. For reasons that will become evident once the details of the system are understood, the piston areas of the master unit are made larger than the corresponding piston areas of the valve unit. The advantages of the two-unit system over the prior art single-unit system includes the following:

1. Relatively larger areas of the master piston translates to a shorter stroke which proportionally narrows the airgap through which the electromagnet must pull on the armature in order to overcome the centering force of the spring. Also, assuming the combined effective mass of the two units is made equal to that of the single-unit system so that the spring rates (stiffness) of both systems are equal, the shorter displacement of the master piston translates to a lessen pull by the centering spring. The enhanced magnetic pull and lessen spring pull result in smaller, lower power electromagnets.

2. The configuration of the master unit lends itself to the use of a single centering spring which, because of its shorter displacement, can also be a shorter spring. A short spring is more resistant to inter-coil surging, a particular concern for valves that open and close rapidly as is the case of all spring/mass actuation systems.

3. The reduction in electromagnet power should be sufficient to allow the electromagnet drivers to be embedded within the body of the master units.

4. Adding a dummy valve unit in parallel with the intake valve unit will, once released, step down the amplitude of the valve opening. A small intake valve opening at low engine loads is desirable, especially if the valve is used to throttle the engine.

5. The system features the automatic zeroing of any difference between the valve seating instance and the master piston bottoming instance. Synchronization helps to minimize the closing velocity of the valve which lowers noise and wear.

6. The typically small diameter of the valve piston allows the valve to be caged in a slim axisymmetric cartridge. Besides enclosing the valve, the valve piston and the piston cylinder, the cartridge incorporates the valve seat and a straight-shot and highly streamlined port. Part of the port streamlining involves a valve skirt attached to the back side of the valve head that, for the case of the exhaust valve, also serves to shield the stem from the repeated impinges of high velocity, high temperature, corrosive gases. For the case of the intake valve, the unit can easily include an integral fuel injector and a tunable axisymmetrical inlet track.

7. Because of the slim cartridge of the valve cage there is space for dual intake valve units. For the reasons allowing item 4, a single master unit can simultaneously actuate two valve units.

8. The valves are free of side forces which are produced by cross axial flow of inlet and exhaust gases and by the inherent off-axis force of attached springs. They are also ideally lubricated and free to rotate. These features together with their light weight and their slow closing velocity (made possible in part by synchronization) assures near frictionless operation and a very long life.

The above advantages cannot be shared with the prior art systems described in U.S. Pat. Nos. 5,222,714 and 4,829,947. Nevertheless, these patents as well as this invention can claim engine performance advantages (such as higher power output with greater fuel economy and lower emissions) that are characteristic of camless engine systems wherein the valves can be optimally actuated according to operating conditions.

SUMMARY OF THE INVENTION

The actuation of engine valves is effected by an oscillatory exchange between the potential energy of a spring and the kinetic energy of a mass. When a spring-sprung mass is displaced from its neutral position and released, it will undergo a decaying sinusoidal oscillation which is caused by unavoidable friction. If the alternating acceleration and deceleration forces acting on the mass by the spring are large compared to the damping forces acting on the mass by way of friction, the loss of peak-to-peak amplitude over an one-half cycle of sinusoidal motion will be small. This being the case, a small external force acting on the mass can be made to counter the damping force and also be made to seize the mass at the peak amplitude and hold it for an indefinite period before releasing it to swing back to the opposite end. This means that a closed valve, if it is part of the sprung mass, can likewise be released to open at any desired point in time, then seized and held in the open position for any desired duration before it is released to swing back to the closed position.

In this invention, the sprung mass is concentrated in a valve and in a remote master piston. The spring forces and the external forces act directly on the master piston. The external forces are applied through electromagnets and the subsequent motion of the master piston is transferred hydrostatically to the valve to effect its opening and closing. The ability of an engine computer to select the opening and closing instances according to engine data constitutes variable actuation.

DRAWINGS

SYSTEM CONFIGURATION

Figure 1:
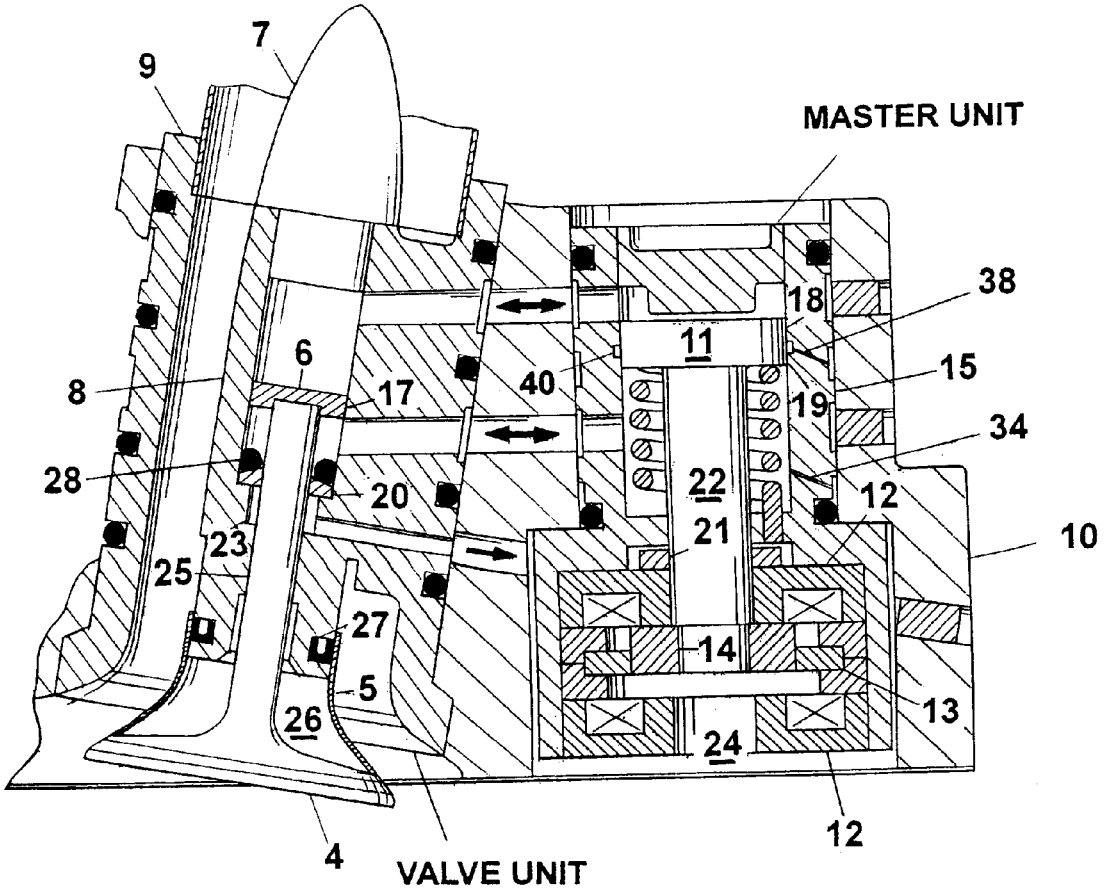
FIG. 1 is a cross section view of a valve unit hydraulically coupled to a master unit.
Figure 2:
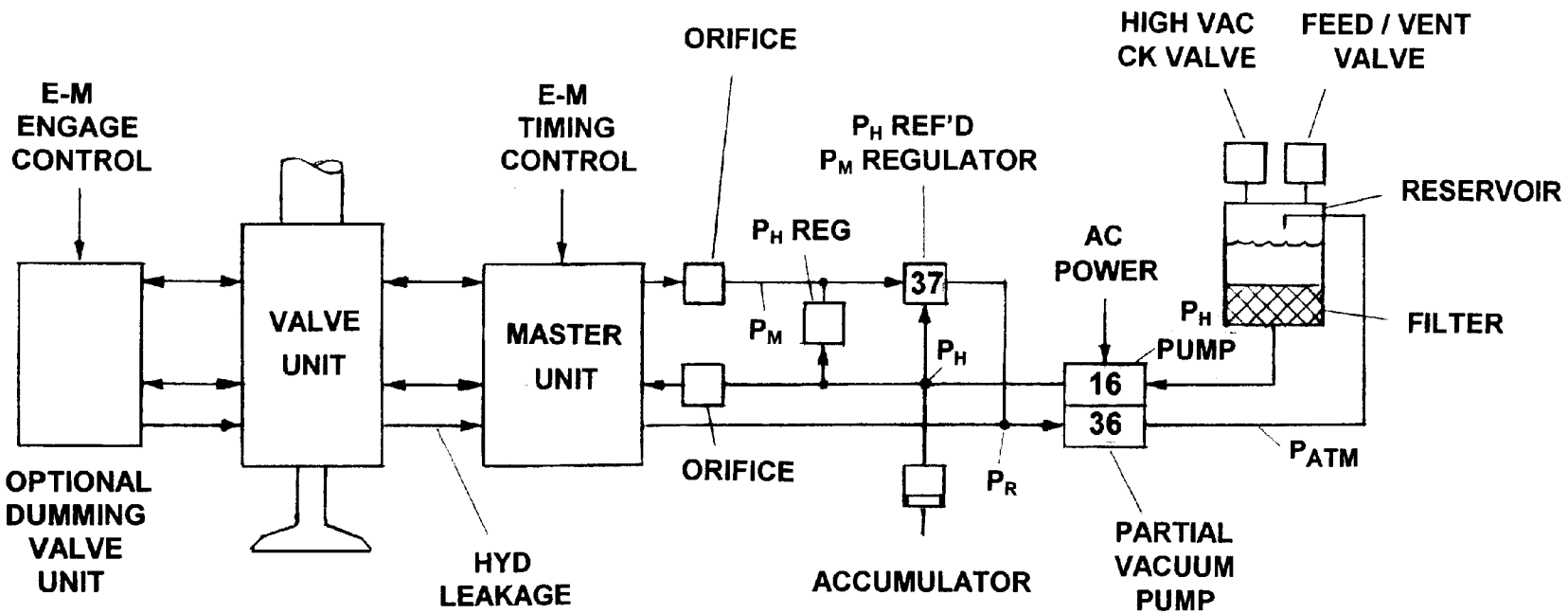
FIG. 2 is a schematic of the overall valve actuation system.

FIG. 1 shows an engine valve unit (1) hydrostatically slaved to a master unit (2) through a pair of push-pull lines (3). FIG. 2 shows how the two units fit in the overall system. The moving mass of the valve unit consists of a valve (4), a valve skirt (5) attached to the valve head and an unbalanced piston (6) attached to the tip of the valve stem. For the case of an intake valve unit, a fuel injector may be conveniently mounted in the cap (7) of the unbalanced piston cylinder (8). These components are contained in a valve cage/port cartridge (9) that fits in the engine cylinder head (10). The components of the master unit includes a spring-sprung, unbalanced piston (11), a piston cylinder (15) and a bistable electromagnet consisting of two stators (12) each containing a coil and associated core, a shared permanent magnet (13) and an armature (14). These components are also contained in a cartridge that fits in the engine head. The similarity in the pistons of the two units permits the chambers of their large and small piston areas to be connected with short lines through the engine head. The system high pressure source needs only to replace fluid that has leaked out of the interior and, therefore, can be a miniaturized, electromagnet-powered pump (16). As such, the entire hydraulic pump can be made in a single unit and in the form of a cartridge. The use of cartridges allow the high pressure ($P_H$), medium pressure ($P_M$) and return ($P_R$) lines to be routed through the engine head, possibly with only two sets of straight lines per engine head, one set for the intake master units and another set for the exhaust master units.

System Seals

Figure 5:
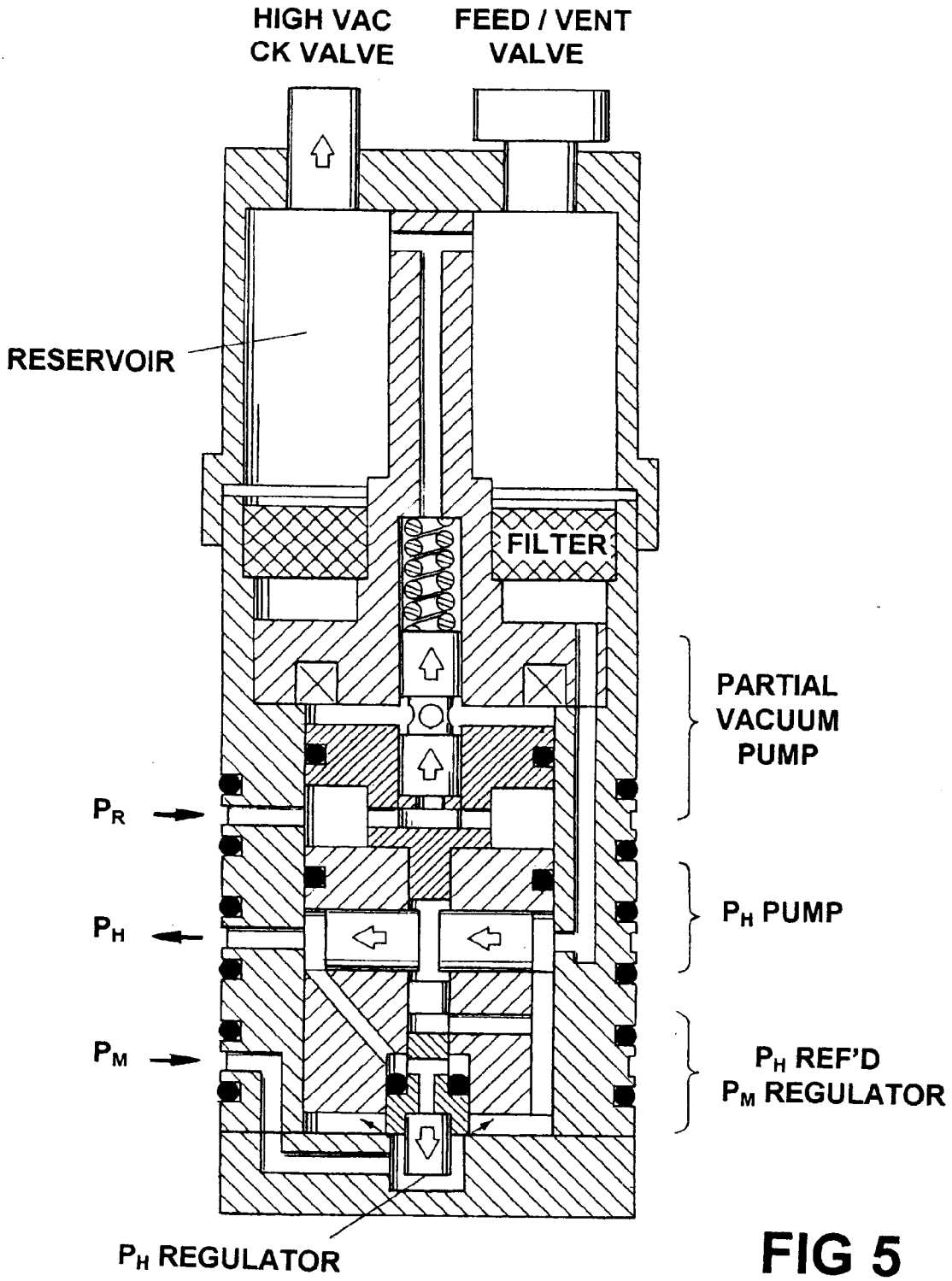
FIG. 5 is a cross section view of an integrated hydraulic/partial vacuum pump unit.

Leakage through the valve piston seal (17) and the master piston upper seal (18) and lower seal (19) is limited to a low level by means of very small radial clearances. Leakage through the self-aligning metal ring seal (20) of the valve stem and the metal ring seal (21) of the master piston shaft (22) are likewise limited by very small clearances. Fluid leaked through the stem ring seal is passed into the guide cavity (23) and from there to the shaft air/fluid chamber (24) of the master unit. There it joins leakage through the piston shaft ring seal and are pulled through the system return line which leads to the partial vacuum pump (36). FIG. 5 shows a design that integrates the partial vacuum pump with the system high pressure fluid pump.

The partial vacuum pump prevents fluid loss through the lower valve guide seal (25) by pulling air from the skirt chamber (26) up through that seal and into the guide cavity and the shaft air/fluid chamber. Unidirection air flow is guaranteed because, with valve motion, a finite amount of air is expected to leak through the dry skirt seal (27) which raises the average pressure in the skirt chamber slightly higher than the partial vacuum pressure in the guide cavity. Also the unidirectional air flow through the lower guide seal should persist in spite of pressure fluctuations in the chambers as the result of valve and master piston motion, since the fluctuations are in unison. The expected choice for the skirt seal is a lip-configured fluoroelastomer such as a PTFE and FKM composite as it exhibits high temperature resiliency and low sliding friction.

In order to minimize viscous damping by the small clearance of the seals, a low viscosity synthetic fluid like those of aircraft hydraulic systems should be used. The low viscosity approach to low damping is feasible since seal leakage varies with the cube of clearance whereas seal viscous friction varies only with clearance. Therefore, the increase in leakage as the result of reduced viscosity can effectively be nullified with a slight reduction in clearance.

The o-ring seal (28) which nests over the self-aligning stem seal is a highly compliant elastomer that performs several functions. When the system is pressurized the seal is squeezed away from the stem into the corner formed by the self-aligning stem seal and the lower part of the piston cylinder wall. In this position sliding wear by the stem is prevented. When the system is turned off, the subsequent loss of system pressure allows the elastomeric seal to snap back to its free-form configuration, making contact with the stem while maintaining contact with the cylinder wall. In this position, the seal becomes a positive static seal which guards against fluid loss. It also provides static friction which, together with the static friction of the skirt seal, helps keep the valves from moving from their closed position.

Electromagnetic Control The master unit electromagnet is composed of two stators (12) each, in turn, consisting of a coil and associate core, and a radially polarized permanent magnet (13) that is held in place by two intermediate ring cores. The five pieces are clamped together to form a single component. The magnet is flanked at its inboard side by a high permeability armature (14) that is bonded to the shaft of the master piston. If a lower cost, bipolar electromagnet is chosen, the magnet is replaced with the high permeability material used by the cores. The flat top and bottom areas of the armature face the flat top and bottom areas of the stator poles. The total airgap between the armature and the stator flat areas determines the displacement of the master piston.

A voltage pulse applied to the coils of the electromagnet weakens the hold on the armature against the pull of the centering spring thereby releasing the master piston. The weakening of the magnet's hold is accomplished by diverting a part of its flux linkage through the pole of the stator to which it is attached and directing it to the pole of the stator at the opposite end. Once the armature reaches the opposite end, it becomes latched to that stator. Release now takes place by pulsing the coils in the opposite polarity. The electrical pulsing of the electromagnet coils not only weakens the hold of the magnet but also provides a force toward the opposite side before the coil current decays. The force is meant only to compensate for viscous damping so that the sprung mass may complete a full half-cycle of motion.

In both U.S. Pat. Nos. 5,222,714 and 4,829,947 the electrical pulse applied to the coils is set higher and/or longer than nominally required in order to account for electromagnetic variances in the capturing and holding force. Over compensation results in a high velocity impact of the armature against the bottom stator when the valve reaches the full-open point and again by the valve against the valve seat when the value closes.

On the other hand, variance and over compensation is minimized by the master unit. This unit lends itself to precise dimensional construction, allows the zeroing of both top and bottom airgaps and is situated in a less severe environment. Moreover, because of the lower power requirements of the electromagnet (the result of lower spring pull and a smaller, zeroing airgaps) there is design room to quicken and shorten the duration of the applied voltage pulse which further lowers variance and the need to over compensate.

Figure 4:
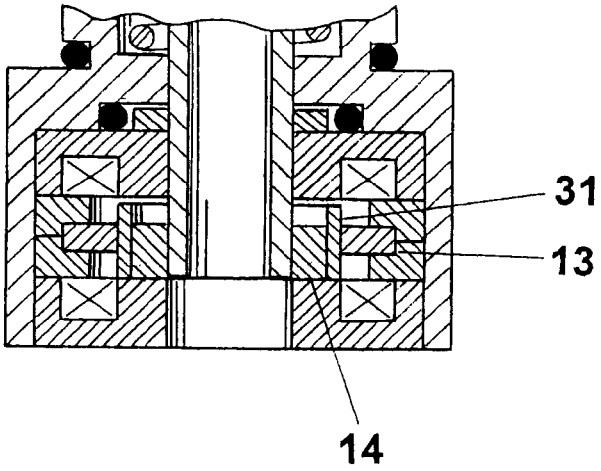
FIG. 4 is a cross section view of the master piston electromagnet containing an intermediate armature.

A scheme by which release of the master piston can be made quicker and more precise is to quickly divert the magnetic flux from the holding side of the armature to the opposite side. FIG. 4 shows the modification made to the electromagnet to effect the quick diversion. A permeable, annular, intermediate armature (31) is added between the main armature (14) and the permanent magnet (13). The intermediate armature is free floating and has an airgap that is significantly smaller than that of the main armature. When both armatures are at the bottom position, only a short electrical pulse applied to the coils will suffice to quickly displace the low mass, intermediate armature over the small airgap. The lessen reluctance path that is created between the permanent magnet and the top core diverts a sufficient amount of flux from the bottom core to release the main armature from that position. Once the main armature also reaches the top stator, the flux through the intermediate armature will permeate through the interior of the main armature and into the top core, thus latching the master piston in that position.

Pressure Control

The average operating pressure (common mode pressure) in the small area chambers of the units is set at $P_H-P_{PO}$ where $P_H$ is the high pressure output of the hydraulic pump (16) and $P_{PO}$ is a small pressure drop across the pump side orifice (34). In the opposite side, the common mode pressure of the large area chambers depends on which end (top or bottom) the master piston is latched. When latched at the top (the valve is wide-open), the large area chamber pressure equals $P_{US}+P_{RO}+P_M$ where $P_M$ is the medium pressure setting of the pressure regulator (37), $P_{RO}$ is the small pressure drop across the regulator side orifice (38) and $P_{US}$ is the pressure drop across the upper master piston seal (18). Since it is desirable that $P_M$ track any variation in $P_H$, the pressure regulator setting is referenced to $P_H$ as shown in FIG. 2. After the master piston is released from the top position, the common mode ratio of $P_H-P_{PO}$ to $P_{US}+P_{RO}+P_M$ becomes equal to the ratio of the large to small piston areas of the units. As the master piston bottoms, the length of the upper seal vanishes, the groove (40) which leads to the regulator orifice becomes exposed, and the large area chamber pressure will begin to drop to $P_{RO}+P_M$.

The final closing rate of the valve will be partly determined by the conductance of the regulator orifice and partly by the final bottoming rate of the master piston which is largely dependent on the rate by which the film of fluid trapped between the bottom flat surface of the armature and the flat surface of the bottom stator core is squeezed out.

In order to prevent the inadvertent unseating of the valve, the opening force due to reduced pressure, $P_{RO}+P_M$, acting on the large piston area of the valve must be set lower than the closing force due to the pressure, $P_H-P_{PO}$ acting on the small piston area.

Because of the short period the valve is unseated, only a minute volume of fluid can leak through seals out or into the large area chamber. If the net volume is zero and the fluid is considered incompressible, the valve will remain synchronized with the master piston throughout the unseated period. Actually, while the valve is transitioning, finite compression and expansion of the chamber fluids will occur due to acceleration and deceleration pressures which are superimposed on the common mode pressures. Therefore, in order to achieve zero valve closing velocity, a net increase in fluid volume of the large area chamber is required which must equal to that lost by compression during closing deceleration and that lost by orifice conductance as the master piston bottoms. Since the net change in fluid volume in the large area chamber through seal leakage will be essentially zero, the required increase may best be achieved by slightly decreasing the ratio of large to small areas of the valve piston relative to those of the master piston.

The small air pressure-biased accumulator (41) that is shown in FIG. 2, comes into play after engine turn-off. If serves to limit the drop in pressure in the pressurized portion of the system to no lower than one atmosphere while the enclosed fluid cools and contracts. Since one atmosphere air pressure will also come to act on the bottom sides of the valve stem seals and the master piston shaft seals, air will not be drawn into the interior.

Sonic Induction

Figure 3:
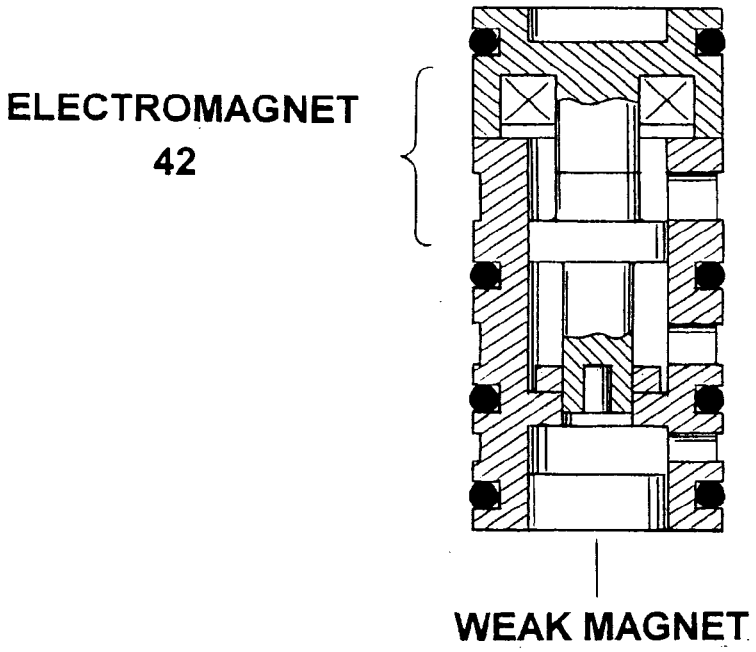
FIG. 3 is a cross section view of a dummy valve unit that may be used to step-down the amplitude of the valve opening.

The dummy valve unit shown in FIG. 3 can be used to step-down the valve opening. Like the valve and master units, it has an unbalanced piston which, when parallel-connected to the intake valve and allowed to move, reduces the open amplitude of the valve by diverting fluid from the valve according to their relative inertances. Varying the open duration of an intake valve that has a small opening will sonically throttle the engine from a idle engine load to roughly ⅔ engine load. In sonic induction, the shock wave that is formed past the valve opening (the vena contrata) breaks up the flow into high intensity, small scale turbulence that promotes a faster, more uniform, and more complete combustion.

When the ⅔ load is reached, the full opening of the valve is enabled and the open duration is correspondingly shortened. The step-up is enabled by latching the dummy valve at the top position by the electromagnet (42). Throttling the engine to still higher loads can continue by lengthening the open duration beyond the shorten point.

Sonic throttling of the intake valve can also be accomplished with two master units connected in parallel to the valve unit. One master unit is sized to displace a small amount of fluid, effecting a small opening of the valve by which load can be varied from idle to a medium level. The second master unit is sized to displace an amount effecting the full opening of the valve needed to vary load from the medium level up to the maximum level.

Figure 6:
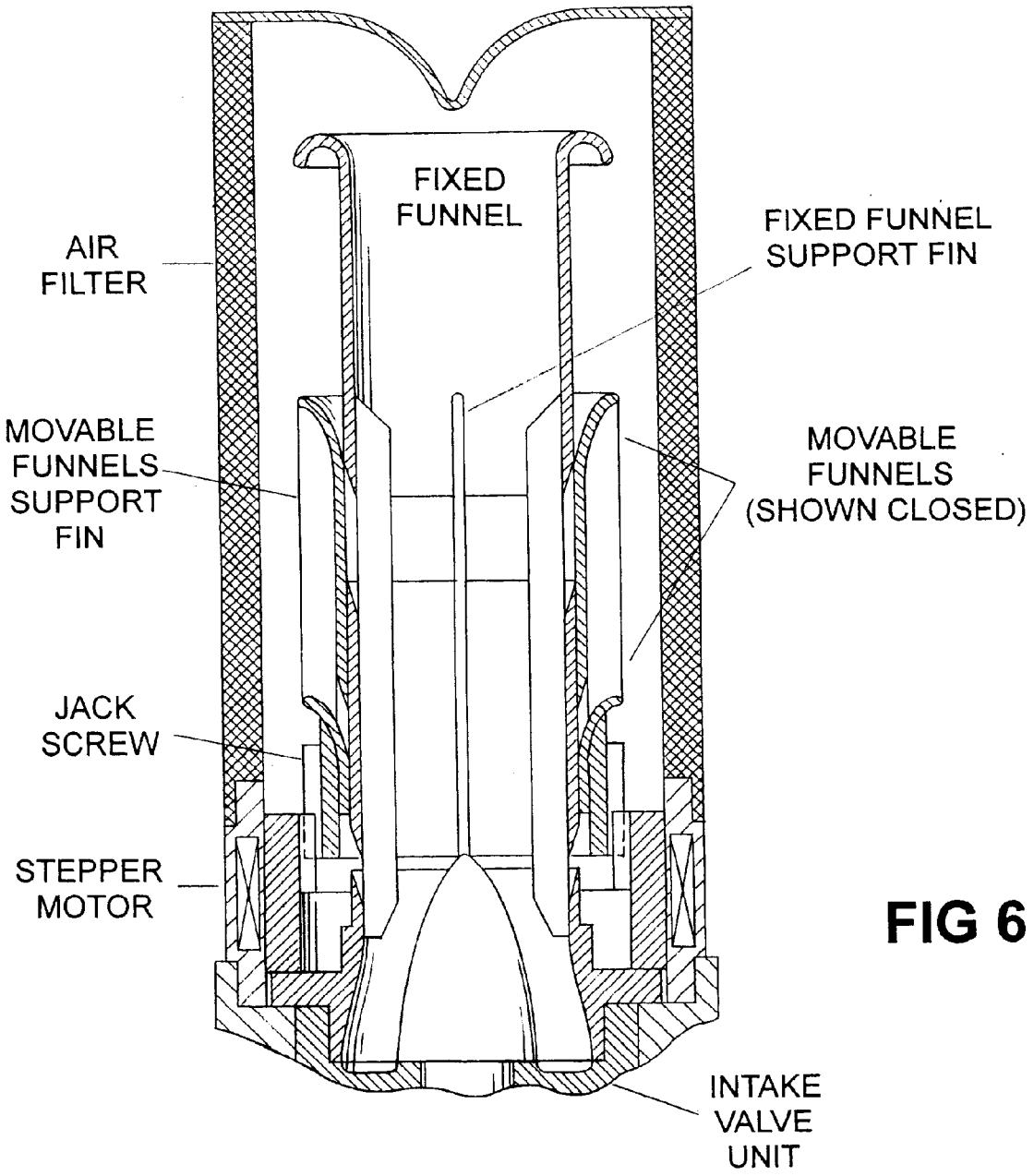
FIG. 6 is a cross section view of a length-tuned inlet tract having two 360-degrees, variable apertures.

Sonic throttling over a shorter range of engine loads should be possible with one intake valve, without the use of a dummy unit or the use of two master units. The following techniques may prove sufficient in achieving this goal:

First, what will help is a pressure wave arriving at the back side of the valve while it is opened; otherwise the sudden, wide opening of the valve which drops the pressure up-stream of the valve may cause the ratio of the up-stream to the down-stream pressures to momentarily fall below the critical sonic point. In order to develop and maintain the required pressure, the length of the inlet tract should vary inversely with engine rpm. FIG. 6 shows an inlet tract having two concentric moveable funnels that gradually open 360-degree apertures on the tract, first the upper one, then both the upper and the lower one, as the funnel assembly is lowered as a function of rpm. The lowering and raising of the funnel assembly is accomplished by a stepper motor driving a screw jack. Full, 360-degrees, apertures introduce a near lossless axisymmetrical flow pattern into the axisymmetric valve cage.

In conjunction with the length-tuned inlet track, a late intake valve opening will also raise the up-stream to down-stream pressure ratio assuring sonic induction at the start of the inlet process.

A second technique that helps to extend the sonic range is to simply reduce by design the amplitude of the valve opening. This approach capitalizes on the low flow losses of the valve/port configuration made possible by axisymmetry and by the streamlining of the valve skirt. In contrast with a conventional valve/port configuration, the new configuration avoids losses resulting from vortexed flow due to a curved port. It also avoids the choking effect by the sharp bend at the base entrance which affects roughly one-third of the valve opening. The skirt also avoids the push back of inlet air by an otherwise flat back face of the rapidly closing valve, an unavoidable characteristic of the actuation concept. Once out of the sonic range, it is estimated that the new configuration will exhibit a flow coefficient of 0.8 (compared to 0.5 for a conventional configuration), approaching 1.0 for a perfect orifice. The bottom line is that a reduced intake valve opening should extend the sonic induction range and still achieve the full load induction of a conventional configuration.

Valve Material

Two characteristics of the valve unit bear on the choice of valve material.

First, the lower the valve mass, the lower the pressure fluctuations of the chambers since these vary directly with mass and inversely with the square of the respective piston areas. Lower fluctuations allow lower common mode pressures. The lower pressures lower seal leakage or if preferred, allow viscous damping to be reduced by opening seal clearance. Since it is also desirable to minimize the size of the units which can only be accomplished by reducing the areas of the pistons, the logical approach is to construct the valve out of a low density material.

Secondly, the valve stresses are minimal. No spring or other mechanical part acts directly on the valve. There is also perfect alignment of the valve seat with the axis of the valve face (a byproduct of an axisymmetrical valve cage). Finally because of the slow valve closing velocity (a characteristic of near perfect synchronization) and the absence of added mass from attached parts, the importance of material strength is minimized. This means that low density, high corrosion resistance, and low wear are the remaining considerations that are paramount in the selection of the valve material.

As such, the above characteristics point to the use of silicon nitride as the logical material for the valve. In the case of the exhaust valve where the temperature that the thin skirt can reach should be quite high, it now can be easily accommodated with the ceramic material.

Emissions Reduction

The fast temperature rise of the thin skirt on the exhaust valve serves to oxidize CO and HC emissions following engine starts (before the catalytic converter becomes hot enough to be effective). Perhaps the oxidation by the skirt can be significantly increased if its surface is implanted with the catalytic metals. In fact it may prove cost effective to line the entire interior of the valve cage since this would also minimize heat transfer to the valve unit and lower the cooling requirement of the engine.

On the intake valve, the valve skirt also serves to lower emissions by shielding the inlet air from exposure to the back side of the heated valve. The cooler inlet air lowers the peak combustion temperature which lowers $NO_X$ and the incidence to knock.

Electromagnet Size Advantage The two-unit system equipped with bipolar (non-magnet type) electromagnets can be parametrically compared with the single-unit system also equipped with bipolar electromagnets on the basis of the average force required to pull the spring-sprung masses from the neutral center position to either end. The comparison is made with and without a silicon nitride-equipped valve unit.

The density of silicon nitride is 0.41 that of a typical, alloy steel, exhaust or intake valve. A silicon nitride valve having a 30 mm diameter head and a 7.6 mm opening will only weight 15 gm. The sprung weight of a steel master piston having piston areas that are three times those of the valve piston is approximately 36 gm. The effective combined weight is 170 gm which is estimated to be 1.8 times higher than the total sprung weight of a comparable electromechanical single unit. The spring rate of the master unit must therefore also be 1.8 times higher in order for the half cycle transition times of the two systems to be equal. However, because the spring deflection and the working airgap of the electromagnet are both one-third as much, the product of the three factors, (1.8) (⅓) (⅓), translates to an electromagnet center-to-end pull that is 0.2 of that required by the single unit system. The pull is still only 0.44 as high with an alloy valve.

The two-unit system equipped with bistable (magnet type) electromagnets can also be compared to the likewise equipped single unit system on the basis of the force required to hold the mass at one end against the pull of the springs. The hold required by the two-unit system will now be (1.8) (⅓) or 0.6 as high as that of the single-unit system. Therefore, assuming the use of lower cost bipolar electromagnets, the two-unit system has a decided advantage over the single-unit one. However, although less force is required, more electrical energy is expected of a bipolar system to capture, hold, and release the sprung mass while less energy is expected in a bistable system to simply release the magnet's hold on the sprung mass. Therefore, it may still prove effective to use magnets in the two-unit system in spite of the less favorable 0.6 force reduction factor.

The above comparisons do not take into account the variances of the single-unit system that are elaborated in the electromagnetic control section. Those variances also raise the energy as well as the force requirements of the electromagnet. Also some amount of impact bounce is suspected of the single-unit systems because of their long, surge-prone springs, each having a spring rate that is half of the total required. This means additional pull must be exerted by the electromagnets of these systems in order to prevent the escape of the sprung mass from the impacted end. On the other hand, the much shorter and stiffer master spring has a surge frequency that is relatively farther out of range of the half cycle frequency. This feature together with the more gentle landing of the master piston greatly reduces, if not eliminates, the bounce event. In view of these features, the 0.2 and 0.6 factors are conservative.

Assembly Techniques

Although two, pre-compressed, centering springs set on both ends of the master piston is the expected spring configuration, the single spring shown in FIG. 1 which has an un-strained length when the piston is at center has obvious advantages. What is required in this configuration is a reliable way of attaching the ends of the spring to the piston and piston cylinder. FIG. 1 shows two schemes by which the ends can be attached. In both methods,laser welding, which capitalizes on the deep penetration of a narrow beam, is proposed.

The attachment of the spring begins by first flat-grinding one end of the spring. That end is then welded to the piston by rotating the piston while the laser beam is radially pointed along the plane of the piston-spring interface. The spring is firmly held in place, concentric with the center line of the piston, while welding takes place. On the opposite side of the spring a short section of the end is assumed to have been turned in the axial direction as part of the coil forming operation. That end is intended to be inserted into a hole drilled through the piston shaft bearing. The radial dimensions from the piston center line to both the bearing hole and the spring end must be equal in order to allow the spring-piston assembly, once inserted into the cylinder, to align and drop into the hole by simply rotating the assembly. Once the assembly is precisely set at the piston center position, that end can be laser welded from the open end of the cylinder.

The assembly of the master unit continues by inserting the top stator and metal ring seal followed by the laser welding of the armature to the shaft. The assembly is essentially completed once the center ring cores and the ring magnet are clamped against the top stator by the welding of the bottom stator to the cylinder.

The assembly of the valve unit is similarly accomplished, again using a step-by step laser welding of the various parts.

The ability of a laser source to precisely point a small diameter beam, in pulse or continuous form, on almost any two mated metals, similar or not similar, provides the basis for the fully automated assembly of the system units. Another advantage is the concurrent increase in hardness, tensile strength and generally improved fatigue resistance of the weld over that of the base metals which is the result of the extremely rapid quenching of the minute weld volume by the base metals.

Engine Operation

Once the valve and master units and the system power supply unit are inserted in the engine cylinder head, the actuation system can be readied for operation by first vacating all interior air by means of a hard vacuum source applied through check valve (46), then allowing gas-free fluid to enter through gate valve (47), enough to fill all the interior spaces except for a small fraction of the reservoir volume. With the master pistons all latched to the bottom end which corresponds to the valve closed position and the valves assuredly held in the closed position, first by interior vacuum then by fluid pressure, the starting of the engine will be by the one-by-one opening of the exhaust and intake valves as a function of engine angular position plus other data fed to the engine control computer. At turn-off the reverse procedure (the one-by-one closing of the opened valves) may be enacted.

Ramifications

Several variations to the valve actuation system thus far described can be made without deviating from the basic concept of the invention. The following are examples of possible variations:

1. Upon engine turn-off, the engine valves may be set all closed, all opened, mixed closed and opened, or all half-opened by the engine computer.

2. During extremely cold weather, the system electromagnets may be activated by the engine computer to preheat the units prior to engine start-up. For example, after the opening of the driver side door, the coils may be pulsed with alternating polarities at a frequency equal to the resonance frequency of the coupled units. After a warming period of, say, 15 seconds, normal engine start-up is allowed.

For the case where the units are initially in the half-opened position, the pulsing operation may be used to incrementally increase the amplitude of oscillation to where the armatures can be captured by the stators. The advantage of this particular operation, which can be incorporated regardless of the starting temperature, eliminates the need for a single high power pulse to offset and capture the armatures.

3. Clean, cool air may be orifice- or check valve-admitted in the skirt chambers of the exhaust valves.

4. In a system where extra small seal clearances are used to yield a very low leakage, the conductance of the medium and high pressure orifices should also be reduced. As such, the medium pressure orifices may be directly connected to the large area chambers, thus eliminating the need for the master cylinder grooves.

5. The metal ring seals of the valve stem and the master piston shaft may be non-metallic, for example, PTFE rings.

6. The high pressure applied to the small area chambers may be pneumatic. The source would probably be a small electromagnetically powered, free piston compressor. Positive air-to-fluid elastomeric seals would need to be added to the valve piston and the lower portion of the master piston. On the fluid side, the medium pressure source can no longer be a pressure regulator. The source may be generated hydrostatically by a small, unbalanced piston reservoir with the smaller piston chamber pressurized by the high pressure pneumatic source.

7. When two valves are driven by a single master unit, inter-valve motion may occur which will cause one valve to open more and the other valve to open less than the openings called by the motion of the master piston. In order to prevent a difference in their full opened position, mechanical stops which limit the valves to their designed fully opened points are needed. The stops may be elastomeric o-rings that are half-buried in grooves cut in the cylinder bores at the point where the bottom faces of the valve pistons just touch the o-rings.

8. In order to prevent inter-valve motion of an intake valve and a dummy valve, the bottom cylinder cap of the dummy unit must limit the stroke of the dummy valve to its designed length and must hold it there with the pull of a weak magnet. However, the magnet may not be required if the pull-up force on the intake valve by the partial vacuum in the skirt chamber is greater than the downward aerodynamic force acting over the valve head.

9. A variation of the dummy valve concept can be used to individually actuate the intake and exhaust valves with one master unit. In order to prevent the opening of all but one valve at a time, the valve units are fitted with dummy valve-type latching electromagnets, logically embedded in the caps of the valve piston cylinders. Since each valve piston must serve as the armature of its electromagnet, they will need to be magnetically permeable. In addition, the transition between the closing and latching of the exhaust valve and the release and opening of the intake valve will require an underlap zone where the switching transitions can take place. Conceivably the electrical pulse required to release a valve and to release the master piston (in order to initiate the opening of that valve) and the reverse electrical pulse required to again release the master piston (in order to initiate the closing of the valve) can originate from one switch driver.

A possible cylinder head arrangement for a high performance engine could consist of two latchable intake and two latchable exhaust valve units and a centrally located master unit with four pairs of control lines radiating out to the four valve units. Two or four spark plugs located between the valves near the edge of the cylinder would complete the configuration.

10. The above variation of the dummy valve concept should prove advantageous when applied to the popular V-2 motorcycle engine. If the pistons of the two cylinders are connected to a common connecting rod journal(as they normally are), it will be possible to individually actuate the intake and exhaust valves of both cylinders with a single master unit. During engine operation, it follows that while the valves of one cylinder are latched in the closed position by their electromagnets in order to allow compression and expansion in that cylinder, the exhaust and intake valves of the other cylinder are sequentially released in order to allow individual actuation by the master unit.

11. The caged valve configuration of FIG. 1 may be substituted with a cageless unit. The valve guide would be slenderized and lengthened to allow the unit to be installed on the engine head with conventional valve ports. Here the valve must be inserted through the valve guide from the cylinder side of the engine head. Thereafter, the valve piston is fastened to the tip of the valve stem which is followed by the capping of the valve piston cylinder. The remainder of the actuation system would be as shown in FIG. 2.

12. As an interim design intended to evaluate the single centering spring concept, a fluidless version of the master unit may be inverted and mounted over a conventional valve stem guided by a conventional valve guide. Here the valve stem would pass through a hollowed master piston, extend through the hollow master piston shaft, and be attached to the end of the shaft. The master cylinder would be fastened to the engine head. The design may also include the evaluation of an electromagnet equipped with the intermediate armature of FIG. 4. A unitized design similar to the one described in U.S. Pat. No. 5,350,153 should be favored.

13. The second connection of the valve piston cylinder to the valve cage may, in the case of the intake valve unit, house a discharge line leading from a fuel injector valve in the cylinder cap. The discharge line may feed two nozzles, one on each side of the connection, such that quasi-direct fuel injection into the combustion chamber is effected.

14. The actuation system lends itself to a stratified charge-operated engine using a fuel-rich mixture, injection scheme. A four-valve-per-cylinder engine with the valves alternately arranged (intake, exhaust, intake, exhaust) around a central spark plug is envisioned. By slight modifications to the intake valve units, the arrangement can be made to form a homogenous cloud next to the spark plug.

First, the usual small inclinations of these units from the engine cylinder axis are now offset from the axis in order to promote a swirl motion to the inducted air. Also, the outer side valve cage/cylinder connections are given a slight twist which, by imparting a spiral motion to the inlet air, enhance the swirl motion in the cylinder. Secondly, the injectors, most likely the air-assisted type are pointed toward the inner sides of the valve skirts along their bottom edges.

The turn-on and turn-off of the injectors are variably set to effect injection at the tail end of the valve openings. A delayed turn-off of injected air may be required in order to assure that essentially all of the fuel is inducted before the valves close.

The choice of injector nozzle must permit the highly fuel-rich injection to be mixed with the swirling flow field of the cylinder with the spread and penetration that culminates in a slightly fuel-rich homogeneous cloud at the top center of the combustion chamber. The pure moment-induced swirl made possible by two oppositely positioned intake valves is essential. The pure moment prevents tumbling components of motion from developing, thereby setting the stage for the formation of a sharply defined, centrally located cloud that can last up to the point of ignition.

Ideally, the air-to-fuel mass ratio of the cloud should be maintained on the rich side of stoichiomatric while its size is made to grow with increasing engine load, regardless of engine rpm. This feat is believed to be possible by varying in concert the timing and the amount of fuel and air introduced by the injectors and by the control of the opening and closing instances of the intake and exhaust valves.

15. The cartridge of the master unit as shaped by the electromagnet must be inserted through the bottom side of the engine head. By locating the electromagnet at the top side, the cartridge may be inserted from the top side of the head.

16. Although the cartridge of the valve unit is shaped to be inserted from the bottom side of the head, it can also be shaped to be inserted from the top side with provision to clamp it down against the force of the combustion chamber pressure.

17. Regardless through which side the valve cartridges are inserted, the assembly procedure no longer requires the engine head to be physically separated from the engine block. An integrated casting is advantageous from the standpoint of lower weight, lower localized stress, a more uniform temperature distribution and lower assembly cost. Furthermore, because of the vastly simplified geometry of the head area, it should be possible to die cast the entire single piece block.

18. The pump side orifice of the master unit may be enlarged (eliminated) should a constant, non-fluctuating pressure in the small area chambers prove desirable.

19. Several axially oriented holes may be drilled through the armature and radially through the hollow shaft above the armature in order to reduce air pumping losses.

20. It should be obvious that either of the two schemes described for attaching the ends of the master piston spring can apply to both ends.

21. If filtered engine oil (presumably synthetic) is injected at a minute rate through the feed/vent valve of FIG. 5 and the excess (which includes air) is routed through the hard vacuum check valve back to the engine oil sump, the need for a sensor to check fluid level can be eliminated.

22. The coils of the electromagnet stators may be driven jointly in series or in parallel, or driven separately with distinct timing and pulse duration.

23. The flux density through the magnet of the bistable electromagnet may be maintained near the saturation level, essentially independent of temperature variations, by passing current from a constant current source through the coils in magnet-reinforcing polarities. The current pulses effecting release of the armature from the stator poles are simply superimposed on the constant current. Incorporating a constant current through the coils enables the choice of magnet-equipped electromagnet or an all-permeable electromagnet.

24. Although the electromagnet shown in FIG. 1 is configured as either a bistable or bipolar type, it may be configured strictly as a bipolar type like the specific design described in U.S. Pat. No. 5,222,714.

25. Redundancy may be incorporated throughout the electronic subsystem in order to allow actuation of the valves in spite of one or more failures.

26. The shape of the master piston allows mass to be electromagnetically attached to the piston shaft in order to lower the opening and closing transition velocity of the valve, a desirable feature for engine operation from starting rpm to a medium rpm. It may then be detached to raise the transition velocity for operation from the medium rpm to the maximum rpm.

27. The expansion and compression of air in the valve skirt chambers can be reduced by increasing the valve stem/guide diameters in the area between the valve guide cavity and the end of the valve guide. In order to minimize the addition of mass to the valve, only a small annulus that interfaces the guide should be attached to (or machined off) the valve stem.

I claim the following:

1. A variable actuation system for engine valves based on the natural oscillatory motion of two hydrostatically coupled masses, one mass consisting of an engine valve having an unbalanced piston at the tip of its stem, the other mass consisting of an unbalanced, spring-sprung, master piston; a pair of hydraulic lines connecting the chambers of the large and small areas of the valve piston with the chambers of the large and small areas of the master piston, the ratio of the large to small areas of the valve piston is essentially equal to the ratio of the large to small areas of the master piston; a system high pressure pump and a system medium pressure regulator respectively connected through orifices to said small area chambers and said large area chambers; a system hydraulic reservoir wherein fluid leaked out of the small and large area chambers is collected and fed to the high pressure pump; an electromagnet acting to hold, release and capture the spring-sprung master piston to effect a full cycle of motion of the coupled masses, the first half cycle of motion initiated by releasing the hold of the master piston from the initial peak amplitude position, said first half cycle terminated by capturing and holding the master piston at the opposite peak amplitude position, that position held for an indefinite period; the second half cycle of motion again initiated by releasing the hold of the master piston from the opposite peak amplitude position and terminated by capturing and holding the master piston once again at the initial peak amplitude position, that position held for an indefinite period; said first and second half cycles of motion of the coupled masses corresponding to the opening and closing of the valve.

2. The valve actuation system of claim 1, consisting in part of a master unit wherein the spring-sprung unbalanced piston is contained in a three-chamber cylinder, the top fluid-filled chamber of said cylinder partly formed by the large area of the piston, the bottom air/fluid-filled chamber partly formed by the piston shaft, the middle fluid-filled chamber formed by the small area of the piston and a piston shaft bearing that serves to partition the middle fluid-filled chamber from the bottom air/fluid-filled chamber, said middle fluid-filled chamber enclosing the motion-inducing spring, one end of the spring attached to the small area of the piston and the opposite end attached to the shaft bearing, a self-aligning ring seal positioned to seal the fluid in the middle fluid chamber from the bottom air/fluid chamber, the middle fluid chamber communicating through a high pressure orifice located in the cylinder wall with the system high pressure pump, the top fluid chamber indirectly communicating through the top piston seal with a groove on the bore of the cylinder when the piston is off its bottom position, the top fluid chamber directly communicating with the groove when the piston is at its bottom position, said groove, in turn, communicating through a medium pressure orifice located in the cylinder wall with a system medium pressure regulator; a partial vacuum pump communicating with the bottom air/fluid chamber to expel therefrom air and fluid into the system hydraulic reservoir; the armature of an electromagnet attached to the end of the piston shaft, a stator assembly of the electromagnet attached to the piston cylinder, two face areas of the stator assembly positioned to interact with the top and bottom face areas of the armature, a common pole of the stator assembly interfacing with the mid-section of the armature.

3. The valve actuation system of claim 1 consisting in part of a valve unit wherein the piston driven valve is contained in an axisymmetrical valve cage that incorporates a two-chamber valve piston cylinder, the top chamber of the cylinder formed by a streamlined cylinder cap and the large area of the unbalanced piston, the bottom chamber formed by the small area of the unbalanced piston and the top side of a self-aligning ring seal, an air/fluid cavity formed by the bottom side of the ring seal and a valve guide which extends below the piston cylinder, a valve seat at the bottom end of the valve cage, at least one connection between the piston cylinder and the valve cage, one said connection containing the fluid lines that hydraulically couple the valve to the master piston, and a leakage line that leads from the air/fluid cavity to the bottom of the air/fluid-filled chamber of the master piston cylinder; an essentially annular passage for either inlet or exhaust gas, the innermost surface of said passage consisting of a skirt attached to the valve head and which extends over part of the valve guide, the remaining innermost surface consisting of the exterior surfaces of the valve guide, the valve piston cylinder, and the streamlined cylinder cap; the outermost surface of said annular passage consisting of the interior surface of the cage and part of the interior surface of an inlet or exhaust tract attachable to the top end of the cage; an expanding and contracting air chamber formed by the valve skirt, the bottom end of the valve guide and by the back side of the valve head, an elastomeric seal embedded in the lower end of the valve guide and in sliding contact with the valve skirt; a two-part stem seal nested over the top of the valve guide, the first part consisting of a self-aligning ring having an inside diameter in sliding contact with the valve stem and a flat seating surface mating with the top flat surface of the valve guide, the second part of the stem seal consisting of a compliant elastomeric seal that is capable of being squeezed into the corner formed by the lower end of the piston cylinder wall and the slanting surface of the ring seal when the bottom chamber is pressurized, said elastomeric seal also capable of making contact with the valve stem when the bottom chamber is depressurized.

4. The valve actuation system of claim 1 wherein two valves units are connected in parallel to one master piston unit.

5. The parallel connected valves of claim 4 wherein one of the two valves is a dummy valve which is free to move within the limits set by the two cylinder end caps with a stroke that corresponds to the relative inertance of the paralleled valves, the dummy valve restrained from further motion once it makes contact with the bottom cylinder end cap by means of a weak latching magnet in order to prevent inter-valve motion, said dummy valve also latchable by electromagnet means to the top cylinder end cap which corresponds to a closed valve position in order to effect the full opening of the real valve.

6. The master unit of claim 2, two said units connected in parallel to an intake valve, one unit sized to displace a small amount of fluid effecting a small opening of the valve, the second unit sized to displace a relatively large amount of fluid effecting the full opening of the valve; the small displacement unit operated when engine load is varied from idle to a medium level, the large displacement unit operated when engine load is varied from the medium level up to the maximum level.

7. The master unit of claim 2 wherein the attachment of the spring to the small area of the master piston is accomplished by first flat-grinding one end of the spring with the grounded surface perpendicular to the center spring line, that end of the spring held against the small area of the piston with the spring center line coinciding with the piston center line, the mated piston and spring rotated about their common axis while their common interface is laser welded with the laser beam pointing through the plane of the interface; the attachment of the opposite end of the spring to the bearing of the piston shaft by first having turned a short section of that end in the axial direction during the forming of the coil and by first having drilled a hole through the shaft bearing, also in the axial direction, the radial distance of the hole center to the cylinder center line equal to the radial distance of the turned end to the spring center line such that by inserting the welded piston/spring assembly in the master cylinder and by rotating the assembly, the turned end, once aligned to and lowered into the hole to the depth corresponding to the center position of the piston, is laser welded to the bearing from the bottom side.

8. The master unit of claim 2 wherein the stator assembly is composed of top and bottom stators, each containing a coil and associated core, one pole of the top stator interacting with the top face area of a ring armature and one pole of the bottom stator interacting with the bottom face area of the armature; the opposite poles of the top and bottom stators extending through two adjacent ring cores therein forming a single common pole, a radially polarized permanent ring magnet nested between the two ring cores, the inner surface of the ring magnet extending inwardly and in close proximity to the outer surface of the ring armature, the two ring cores and ring magnet clamped in place by the outer poles of the top and bottom stators; a constant current applied to the coils of the top and bottom stators, said current set in magnet-reinforcing polarities; a pulsed current superimposed on the constant current, said pulsed current applied in alternating polarities, one polarity releasing the armature from one stator, the opposite polarity releasing the armature from the opposite stator.

9. The electromagnet of claim 8 wherein the small clearance between the cylindrical surfaces of the ring armature and the ring magnet is widened to interpose a free floating intermediate armature, the length of the intermediate armature made longer than the length of the main ring armature in order to narrow the working airgap.

* * * * *